US010064453B2

(12) United States Patent
Mizumoto et al.

(10) Patent No.: US 10,064,453 B2
(45) Date of Patent: Sep. 4, 2018

(54) MOLDED SURFACE FASTENER

(71) Applicant: YKK Corporation, Tokyo (JP)

(72) Inventors: Kazuya Mizumoto, Toyama (JP); Mineto Terada, Toyama (JP); Yoshiyuki Fukuhara, Toyama (JP); Hiromasa Abe, Toyama (JP)

(73) Assignee: YKK Corporation (JP)

( * ) Notice: Subject to any disclaimer, the term of this patent is extended or adjusted under 35 U.S.C. 154(b) by 282 days.

(21) Appl. No.: 15/152,754

(22) Filed: May 12, 2016

(65) Prior Publication Data

US 2016/0331085 A1 Nov. 17, 2016

(30) Foreign Application Priority Data

May 12, 2015 (JP) ..... 2015-097654

(51) Int. Cl.
*A44B 18/00* (2006.01)
*H01F 7/02* (2006.01)

(52) U.S. Cl.
CPC ..... *A44B 18/0049* (2013.01); *A44B 18/0076* (2013.01); *H01F 7/0252* (2013.01)

(58) Field of Classification Search
CPC ..... A44B 18/0046–18/0065; A44B 18/0076; A44B 18/008; A44B 18/0088; H01F 7/0252
See application file for complete search history.

(56) References Cited

U.S. PATENT DOCUMENTS 4,784,890 A * 11/1988 Black ..... A44B 18/0076 24/306
4,842,916 A * 6/1989 Ogawa ..... A44B 18/0073 24/444
5,286,431 A * 2/1994 Banfield ..... A44B 18/0049 264/134
5,540,970 A * 7/1996 Banfield ..... A44B 18/0049 24/306
5,725,928 A 3/1998 Kenney et al.
5,766,385 A * 6/1998 Pollard ..... A44B 18/0076 156/227
5,785,784 A * 7/1998 Chesley ..... A44B 18/0049 156/231

(Continued)

FOREIGN PATENT DOCUMENTS

JP 04-40808 U 4/1992
WO 03/030672 A1 4/2003

*Primary Examiner* — Robert Sandy
*Assistant Examiner* — Louis A Mercado
(74) *Attorney, Agent, or Firm* — Kilpatrick Townsend & Stockton LLP

(57) ABSTRACT

An integrally moldable molded surface fastener retains practical rigidity, while having attraction force to a magnet and is prevented from being easily broken during attachment and detachment handlings to and from loop-shaped engaging elements. A first resin composition including 80% by mass or more of a thermoplastic polyester and containing no magnetic material is used in at least a part of a substrate portion, and a second resin composition containing a thermoplastic polyester, a thermoplastic polyester elastomer and a magnetic material at a certain proportion is used in at least a part of engaging elements of the molded surface fastener.

10 Claims, 10 Drawing Sheets

(56) References Cited

U.S. PATENT DOCUMENTS

| | | | | | |
|---|---|---|---|---|---|
| 5,786,061 | A * | 7/1998 | Banfield | A44B 18/0076 | 24/442 |
| 5,945,193 | A * | 8/1999 | Pollard | A44B 18/0076 | 24/306 |
| 6,460,230 | B2 * | 10/2002 | Shimamura | A44B 18/0076 | 24/306 |
| 6,540,863 | B2 * | 4/2003 | Kenney | A44B 18/0076 | 156/244.25 |
| 7,648,751 | B2 * | 1/2010 | Janzen | A44B 18/0076 | 24/442 |
| 7,818,850 | B2 * | 10/2010 | Billarant | A44B 18/0076 | 24/306 |
| 8,399,086 | B2 * | 3/2013 | Itoh | A44B 18/0076 | 24/452 |
| 9,271,547 | B2 * | 3/2016 | Terada | A44B 18/0049 | |
| 9,433,262 | B2 * | 9/2016 | Okuda | A44B 18/0049 | |
| 9,445,650 | B2 * | 9/2016 | Murasaki | A44B 18/0076 | |
| 2006/0269634 | A1 * | 11/2006 | Westeel | A44B 18/0076 | 425/4 R |
| 2009/0013506 | A1 * | 1/2009 | Mizuhara | A44B 18/0069 | 24/442 |
| 2009/0276986 | A1 * | 11/2009 | Janzen | A44B 18/0076 | 24/442 |
| 2015/0230564 | A1 * | 8/2015 | Fujisawa | A44B 18/0076 | 24/444 |
| 2017/0119107 | A1 * | 5/2017 | Okuda | A44B 18/0076 | |
| 2017/0295890 | A1 * | 10/2017 | Imai | A44B 18/0076 | |

* cited by examiner

MOLDED SURFACE FASTENER

The present application claims priority of Japanese Patent Application No. 2015-097654, filed on May 12, 2015 and entitled "Molded Surface Fastener", the entire contents of which are hereby incorporated by reference.

TECHNICAL FIELD

The present invention relates to a molded surface fastener. More particularly, the present invention relates to a molded surface fastener which is integrated into a foam surface when the foam is molded.

BACKGROUND ART

Seats of cars and trains, various sofas, office chairs and the like adopt a structure which covers a cushion body with a covering material, and which has a depression shape that satisfies ergonomic requirements such as the maintaining of seating posture and prevention of fatigue due to seating for a long time. In the seat and the like having such a depression shape, they employ a foamed body as a cushion body 111 which has fixed a surface fastener 110 onto the depressed shape portion, and the cushion body and the covering material are fixed by engagement between one surface fastener 110 integrated into the cushion body 111 and other surface fastener attached to the back surface of the covering material, in order to prevent the covering material from rising up from the cushion body in the depression shape portion, as shown in FIG. 11.

An example of producing the cushion body in which the surface fasteners are integrated into the surface is shown in FIG. 12. As shown in this figure, the cushion body which is a foam molded product integrated with the surface fasteners 122 is produced by placing the surfaces having the engaging elements of the surface fasteners 122 within a desired mold 121 so as to bring into contact with the mold surface, injecting a foam resin raw material within the mold 121, and foaming the foam resin raw material. The cushion body is often made of a polyurethane foam. As a method of fixing the surface fastener 122 on the mold surface, there has been known a method which comprises incorporating a magnetic material into a resin composition configuring the surface fastener, and fixing the surface fastener by attraction force between this magnetic material and magnets 123 placed within the mold 121.

It is known that the surface fastener used in such an application generally comprises a substrate portion in the form of flat plate and a plurality of engaging elements (in a shape of hook or loop) protruding from the substrate portion, and can be produced by integrally molding a thermoplastic resin composition.

Patent Document 1 (WO 2003/030672) proposes to incorporate a magnetic material into a substrate portion or engaging elements, and to integrally mold a surface fastener using a synthetic resin such as polyesters, polyamides, polyolefins, poly(vinyl chloride), polyurethanes, polyolefin-based elastomers, polyester-based elastomers, polyamide-based elastomers, polyisoprene, or other resin compositions comprising a thermoplastic polymer(s). Further, Patent Document 1 discloses a method of extruding a synthetic resin containing magnetic powders and a synthetic resin containing no magnetic powders from each independent pathway within an extruder into molding cavities.

Patent Document 2 (U.S. Pat. No. 5,725,928) discloses that a surface fastener is produced by a substrate portion and engaging elements made of a mixture of a magnetic material and a non-magnetic material, and the non-magnetic material is made of a polypropylene, a polyethylene, a polyamide, a polyester, a polystyrene, polyvinyl chloride, acetal, an acrylate, a polycarbonate, poly(phenylene oxide), a polyurethane, polysulfone and a thermoplastic elastomer. It also discloses that the substrate portion and the engaging elements are molded by co-extrusion molding.

Patent Document 3 (Japanese Unexamined Utility Model Application Publication No. 4-40808) proposes a molded surface fastener in which at least a part of engaging elements or a substrate portion is made from a resin containing from 15 to 40% by volume mixing ratio of magnetic fine particles. It discloses, as the resin, thermoplastic resins such as polyesters, polyamides, polyolefins, poly(vinyl chloride), and polyurethanes. This document discloses that a decreased amount of magnetic material contained in the molded body of the molded surface fastener may result in lower magnetization force so that exact mounting is not possible, and an increased amount of magnetic material may result in a lower flexible property of the surface fastener so that its flexibility becomes poor.

PRIOR ART DOCUMENT

Patent Document 1: WO 2003/030672
Patent Document 2: U.S. Pat. No. 5,725,928
Patent Document 3: Japanese Unexamined Utility Model Application Publication No. 4-40808

SUMMARY OF INVENTION

Problem to be Solved by the Invention

The molded surface fastener having hook-shaped engaging elements and used for the application as described above requires practical rigidity, and is desired to have attraction force to a magnet(s) placed within a mold for a cushion body as well as higher toughness so as to prevent them from being easily broken during attachment and detachment handlings to and from loop-shaped engaging elements.

Conventionally, various thermoplastic polymers as resin materials configuring the surface fastener has been proposed, but no molded surface fastener having at the same time such properties has been developed yet. A thermoplastic polyester composition such as PBT has good mechanical properties, but when incorporating into this a magnetic material such as iron powders, the polyester is degraded and becomes brittle due to the influence of moisture present on the surface of magnetic material. Thus, the forming of hook-shaped engaging elements by such a resin composition may cause a higher risk of cracking by attachment and detachment handlings to and from the loop-shaped engaging elements.

On the other hand, the thermoplastic elastomer is useful in that there is an effect of suppressing cracking in the hook-shaped engaging elements, but there remains anxiety for rigidity. Furthermore, even if one tries to use separately the resins, such as by using the thermoplastic elastomer for the hook-shaped engaging elements and using the thermoplastic polyester for the substrate portion, it is difficult to co-extrusion mold the engaging elements and the substrate portion, because fluidities of both resins are different from each other.

Further, when the magnetic fine particles are incorporated into the resin at volume mixing ratio as proposed in Patent Document 3, a melt viscosity of the resin is increased, so that the co-extruding molding with a resin containing no magnetic fine powders becomes difficult.

The present invention has been created in view of the above circumstances. One of objects of the present invention is to provide an integrally moldable molded surface fastener that retains practical rigidity, while having attraction force to a magnet and preventing it from being easily broken during attachment and detachment handlings to and from loop-shaped engaging elements. Preferably, one of objects of the present invention is to further provide a molded surface fastener that can be co-extrusion molded. Furthermore, one of other objects of the present invention is to provide a method of producing such a molded surface fastener.

Means for Solving the Problem

The inventors have conducted extensive investigations to solve the above problems and found that a resin composition containing a thermoplastic polyester and a thermoplastic polyester elastomer at a certain proportion is suitable for the engaging elements in the molded surface fastener, because even if this resin composition contains the magnetic material, its high moldability is maintained, and in addition, a molded product of such resin composition has superior toughness. The present invention has been completed on the basis of such findings.

In a first aspect, the present invention provides a molded surface fastener, the molded surface fastener being integrally molded using a first resin composition and a second resin composition as materials, the molded surface fastener comprising a substrate portion in the form of plate and a plurality of engaging elements that protrude from one main surface of the substrate portion, at least a part of the substrate portion being made of the first resin composition, and at least a part of the engaging elements being made of the second resin composition, wherein the first resin composition comprises 80% by mass or more of a thermoplastic polyester and does not contain a magnetic material, and wherein the second resin composition comprises a thermoplastic polyester, a thermoplastic polyester elastomer and a magnetic material at a total content of 90% by mass or more, a content of the magnetic material is from 20 to 50% by mass, and a content ratio by mass of the thermoplastic polyester and the thermoplastic polyester elastomer is in a range of the thermoplastic polyester/the thermoplastic polyester elastomer=50/50 to 90/10.

In one embodiment of the molded surface fastener according to the present invention, the second composition has a relationship of the equation: $Tm_2-40°\ C. \leq Tm_1 \leq Tm_2$, where $Tm_1$ represents a melting point of the thermoplastic polyester elastomer and $Tm_2$ represents a melting point of the thermoplastic polyester.

In another embodiment of the molded surface fastener according to the present invention, both the first resin composition and the second resin composition have MVR at 260° C. of 0.3 $cm^3$/10 min or more and 20 $cm^3$/10 min or less.

In a further embodiment of the molded surface fastener according to the present invention, a ratio ($MVR_2/MVR_1$) of the MVR of the second resin composition ($MVR_2$) to the MVR of the first resin composition ($MVR_1$) is from 0.5 to 40.

In a further embodiment of the molded surface fastener according to the present invention, the molded surface fastener is comprised of three regions: a central part having boundary lines along its longitudinal direction; and left and right side edge parts thereof; wherein each of the three regions has the substrate portion and the engaging elements, wherein for the central part, both the substrate portion and the engaging elements are made of the second resin composition, and wherein for the left and right side edge parts, both the substrate portion and the engaging elements are made of the first resin composition.

In a further embodiment of the molded surface fastener according to the present invention, the molded surface fastener is comprised of three regions: a central part having boundary lines along its longitudinal direction and left and right side edge parts thereof; wherein each of the three regions has the substrate portion and the engaging elements, wherein for the central part, at least a part of the substrate portion is made of the first resin composition and all the engaging elements are made of the second resin composition, and wherein for the left and right side edge parts, both the substrate portion and the engaging elements are made of only the first resin composition.

In a further embodiment of the molded surface fastener according to the present invention, the substrate portion has the first resin composition more than the second resin composition by volume fraction, and the engaging elements has the second resin composition more than the first resin composition by volume fraction.

In a further embodiment of the molded surface fastener according to the present invention, the volume fraction of the second resin composition to the first resin composition is the second resin composition/the first resin composition=10/90 to 90/10.

In a further embodiment of the molded surface fastener according to the present invention, said one main surface of the substrate portion further comprises a pair of left and right protective wall sections placed along the longitudinal direction on the outerside in the width direction of the plurality of engaging elements, and the protective wall sections are made of the first resin composition.

In a further embodiment of the molded surface fastener according to the present invention, at least a part of another main surface of the substrate portion is made of the first resin composition.

EFFECTS OF THE INVENTION

Since a resin composition containing a magnetic material as proposed by the present invention exhibits superior toughness, a molded surface fastener is provided, which prevents breakage due to attachment and detachment handlings to and from loop-shaped engaging elements while having attraction force to the magnet, when hook-shaped engaging elements of the molded surface fastener is made of such a resin composition. Further, the substrate portion can retain practical rigidity by using the polyester resin composition containing no magnet, and the material cost can also be reduced.

Furthermore, in a preferable embodiment of the molded surface fastener according to the present invention, it is possible to co-extrusion mold a resin composition that does not contain a magnetic material (the first resin composition) and a resin composition containing a magnetic material (the second resin composition). This allows easy integral molding and an increased production efficiency, and also a further reduction of production cost.

BRIEF DESCRIPTION OF DRAWINGS

FIG. 6 (*b*) shows parts made of the second resin composition in the molded surface fastener according to one embodiment of the present invention, using a sectional view corresponding to FIG. 4.

FIG. 6 (*c*) shows parts made of the second resin composition in the molded surface fastener according to one embodiment of the present invention, using a sectional view corresponding to FIG. 5.

FIG. 7 (*b*) shows parts made of the second resin composition in the molded surface fastener according to another one embodiment of the present invention, using a cross-sectional view corresponding to FIG. 4.

FIG. 7 (*c*) shows parts made of the second resin composition in the molded surface fastener according to another one embodiment of the present invention, using a cross-sectional view corresponding to FIG. 5.

FIG. 8 (*b*) shows parts made of the second resin composition in the molded surface fastener according to further another one embodiment of the present invention, using a cross-sectional view corresponding to FIG. 4.

FIG. 8 (*c*) shows parts made of the second resin composition in the molded surface fastener according to further another one embodiment of the present invention, using a cross-sectional view corresponding to FIG. 5.

FIG. 9 (B) is a schematic diagram of a production device for a second molded product when producing a molded surface fastener by a double molding method.

FIG. 10 (B) shows a structure of an extrusion die when producing a molded surface fastener by a co-extrusion molding.

Figure 1:
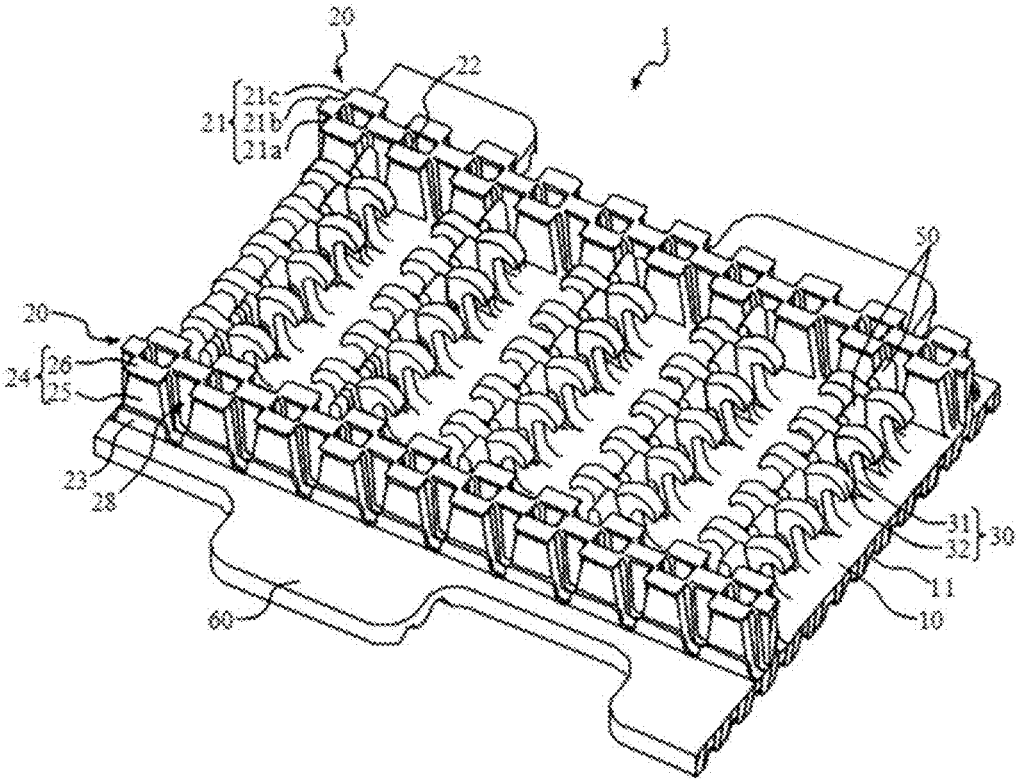
FIG. 1 is a partial perspective view showing a molded surface fastener according to one embodiment of the present invention.

MODES FOR CARRYING OUT THE INVENTION (1. First Resin Composition)

In one embodiment, the molded surface fastener according to the present invention is a integrally molded surface fastener made of a first resin composition and a second resin composition as materials, wherein the molded surface fastener comprises a substrate portion in the form of a plate and a plurality of engaging elements protruding from one main surface (also referred to as "top surface") of the substrate portion, and at least a part of the substrate portion is made of the first resin composition. Since the first resin composition is based on a thermoplastic polyester and does not contain a magnetic material, it has excellent adhesiveness when integrating the surface fastener into a cushion body which is often made of a polyurethane foam. Thus, when the other major surface (also referred to as "bottom surface") of the resin substrate portion, which has a larger contact area with the cushion body, is made of the first resin composition, adhesiveness to the cushion body can be ensured. The remainder of the substrate portion may be made of the second resin composition.

The first resin composition has an advantage of being capable of stably providing appropriate rigidity. In addition, it has an advantage of lower material costs because of simple composition. Thus, the use of the first resin composition for at least a part of the substrate portion can ensure practical stiffness and realize a reduction in material cost for the molded surface fastener. The first resin composition must not be provided on the bottom surface of the resin substrate portion for the above reasons. Another means for ensuring higher adhesiveness includes, for example, an anchoring means in which the bottom surface of the resin substrate portion has concave-convex shapes, or the higher adhesiveness can be also achieved by attaching a member such as a woven, knitted, or nonwoven fabric onto the back side.

When utilizing the first resin composition in a part of the bottom surface of the substrate in order to ensure adhesiveness to the cushion body, more particularly, the first resin composition preferably accounts for 20% or more of the area of the bottom surface of the substrate portion, and more preferably the first resin composition accounts for 40% or more of the area of the bottom surface of the substrate portion, and further preferably the first resin composition accounts for 60% or more of the area of the bottom surface of the substrate portion, and further more preferably the first resin composition accounts for 80% or more of the area of the bottom surface of the substrate portion, and most preferably the first resin composition accounts for 100% of the area of the bottom surface of the substrate portion.

Furthermore, in one embodiment of the molded surface fastener according to the present invention, 30% or more of the volume of the substrate portion may be made of the first resin composition, or 50% or more of the volume of the substrate portion may be made of the first resin composition, or 70% or more of the volume of the substrate portion may be made of the first resin composition, or 90% or more of the volume of the substrate portion may be made of the first resin composition, or 100% of the volume of the substrate portion may be made of the first resin composition. The volume of the substrate portion is preferably set such that the first resin composition is more than the second resin composition, because the second resin composition must be a higher content in the engaging element side than in the substrate side of the molded surface fastener. Such a setting allows attraction force to the magnet to be stronger on the top surface side (engaging element side) than on the bottom surface side of the substrate portion, so that the molded surface fastener can be placed on the magnet suitably arranged on the mold.

For the engaging elements, a part of these elements may be made of the first resin composition, but the whole of these elements cannot be made of the first resin composition because attraction force to the magnet must be ensured. By way of example, 60% or less of the overall volume of the engaging elements present on the molded surface fastener may be made of the first resin composition, or 40% or less of the overall volume of the engaging elements may be made of the first resin composition, or 20% or less of the overall volume of the engaging elements may be made of the first resin composition. To ensure attraction force by magnetic force, the proportion of the first resin composition and the second resin composition in the overall volume of the engaging elements is preferably set such that the second composition is higher.

The components of the first resin composition are described in detail. The first resin composition comprises 80% by mass or more of a thermoplastic polyester, but does not contain a magnetic material. The first resin composition may preferably comprise 85% by mass or more, and more particularly 90% by mass or more, and further more preferably 95% by mass or more, and by way of example 100% by mass of a thermoplastic polyester. The first resin composition may optionally comprise other polymers and/or additives (e.g., pigments, dyes, heat stabilizers, weathering agents, hydrolysis stabilizers, antioxidants, antistatic agents, flame retardants, mold release agents, ultraviolet absorbers, etc.), without departing from the scope of the present invention, such that the total content of these is 20% by mass or less, preferably 15% by mass or less, more preferably 10% by mass or less, and further more preferably 5% by mass or less. For example, the first resin composition may comprise the other polymers in a total amount of 20% by mass or less, typically 10% by mass or less, more typically 10% by mass or less, further 5% by mass or less, and further 0% by mass, and may comprise the additives in a total amount of 20% by mass or less, typically 15% by mass or less, more typically 10% by mass or less, further 5% by mass or less, and further 0% by mass. The polymers and additives may be used alone or as a combination of two or more of these.

The thermoplastic polyester is generally a polymer or a copolymer which results from polycondensation reaction based on a dicarboxylic acid (or an esterified derivative thereof) and a diol (or an esterified derivative thereof), and which has heat softening properties. The dicarboxylic acid includes, for example, aromatic dicarboxylic acids such as terephthalic acid, isophthalic acid, 2,6-naphthalene dicarboxylic acid, 1,5-naphthalene dicarboxylic acid, bis(p-carboxyphenyl)methane, anthracene dicarboxylic acid, 4,4'-diphenyl ether dicarboxylic acid, biphenyl-4,4'-dicarboxylic acid, and 5-sodiumsulfoisophthalic acid; aliphatic dicarboxylic acids such as adipic acid, sebacic acid, azelaic acid, and dodecadioic acid; alicyclic dicarboxylic acids such as 1,3-cyclohexane dicarboxylic acid, and 1,4-cyclohexane dicarboxylic acid; and esterified derivatives thereof. These may be used alone or as a combination of two or more of these. Further, the diol includes, for example, aliphatic glycols having 2 to 20 carbon atoms such as ethylene glycol, 1,3-propanediol, 1,4-butanediol, neopentyl glycol, 1,5-pentanediol, 1,6-hexanediol, and 1,10-decanediol; alicyclic glycols having 2 to 20 carbon atoms such as cyclohexane dimethanol and cyclohexane diol; and esterified derivatives thereof. Two or more of these may be used.

Specific examples of the thermoplastic polyester resin include polybutylene terephthalate, polybutylene(terephthalate/isophthalate), polybutylene(terephthalate/adipate), polybutylene(terephthalate/sebacate), polybutylene(terephthalate/decane dicarboxylate), polybutylene naphthalate, polyethylene terephthalate, polyethylene(terephthalate/isophthalate), polyethylene (terephthalate/adipate), polyethylene(terephthalate/sebacate), polyethylene (terephthalate/5-sodium isophthalate), polyethylene(terephthalate/biphenyl-4,4'-dicarboxylate), polyethylene naphthalate, polytrimethylene terephthalate, polytrimethylene(terephthalate/isophthalate), polytrimethylene(terephthalate/adipate), polytrimethylene(terephthalate/sebacate), polytrimethylene (terephthalate/decanedicarboxylate), polytrimethylene naphthalate, poly(cyclohexane dimethylene terephthalate) and the like. Two or more of these may be contained. Among these, polybutylene terephthalate, polybutylene(terephthalate/decane dicarboxylate), polybutylene naphthalate, polyethylene terephthalate, polyethylene naphthalate, poly(cyclohexane dimethylene terephthalate) and the like are preferred from the viewpoint of moldability. Further, polybutylene terephthalate is more preferable from the viewpoints of strength, heat resistance and shape retaining ability.

2. Second Resin Composition

In one embodiment of the molded surface fastener of the present invention, at least a part of a plurality of engaging elements is made of the second resin composition. As mentioned above, the remainder of the engaging elements may be made of the first resin composition. By making at least a part of the engaging elements using the second resin composition, attraction force to the magnet is improved, and the engaging elements having superior toughness can be obtained. The second resin composition has a high affinity (bond strength) to the first resin composition and good integral moldability with the first resin composition due to the use of a polyester-based resin component. 30% by mass or more of the overall volume of a plurality of engaging elements making up the molded surface fastener may be made of the second resin composition, or 50% by mass or more of the overall volume may be made of the second resin composition, or 70% by mass or more of the overall volume may be made of the second resin composition, or 90% by mass or more of the overall volume may be made of the second resin composition, or 100% by mass of the overall volume may be made of the second resin composition.

In the substrate portion constituting the molded surface fastener, a part of this may be made of the second resin composition. For example, 60% or less of the volume of the substrate portion may be made of the second resin composition, or 40% or less of the volume of the substrate portion may be made of the second resin composition, or 20% or less of the volume of the substrate portion may be made of the second resin composition, or typically between 0% or more and 50% or less of the volume of the substrate portion may be made of the second resin composition.

When configurations of the first resin composition and the second resin composition are viewed from the whole molded surface fastener, substantially these two resin compositions configure separate parts at certain boundaries. That is, it does not mean that the first resin composition and the second resin composition are completely commingled with each other (however, at the boundary between the first resin composition and the second resin composition, they may be permitted to be partially mixed). Such configurations allow the features of the first and second resin compositions as described in another part to be maximized.

When a blending ratio of the first resin composition and the second resin composition is viewed from the whole molded surface fastener, attraction force of the molded surface fastener to the magnet can be improved by increasing a ratio of the second resin composition. Therefore, a volume fraction of the second resin composition to the first resin composition (the second resin composition/the first resin composition) in the whole molded surface fastener is preferably 10/90 or more, and more preferably 20/80 or more, and further more preferably 30/70 or more, and further more preferably 40/60 or more. On the other hand, an increase in the ratio of the second resin composition results in a decrease in the ratio of the first resin composition, but the first resin composition plays a role of improving adhesiveness between the molded surface fastener and the cushion body. The first resin composition also contributes to cost down because it has an inexpensive material cost compared with the second resin composition. Thus, the volume fraction of the second resin composition to the first resin composition (the second resin composition/the first resin composition) in the whole molded surface fastener is preferably 90/10 or less, and more preferably 80/20 or less, and further more preferably 70/30 or less, and further more preferably 60/40 or less.

The second resin composition can comprise a total content of the thermoplastic polyester, the thermoplastic polyester elastomer and the magnetic material of 90% by mass or more. In the second resin composition, the total content of these three components can be preferably comprised of 94% by mass or more, and more preferably 96% by mass or more, and further more preferably 98% by mass or more, and by way of example, 100% by mass. The second resin composition may optionally comprise other polymers and/or additives (e.g., pigments, dyes, heat stabilizers, weathering agents, hydrolysis stabilizers, antioxidants, antistatic agents, flame retardants, mold release agents, ultraviolet absorbers, etc.), without departing from the scope of the present invention, such that the total content of these is 10% by mass or less, preferably 6% by mass or less, more preferably 4% by mass or less, and further more preferably 2% by mass or less. For example, the second resin composition may comprise the other polymers in a total amount of 10% by mass or less, typically 6% by mass or less, more typically 4% by mass or less, further 2% by mass or less, and further 0% by mass, and may comprise the additives in a total amount of 10% by mass or less, typically 6% by mass or less, more typically 4% by mass or less, further 2% by mass or less, and further 0% by mass. The polymers and additives may be used alone or as a combination of two or more of these.

The content of the magnetic material in the second resin composition is preferably 20% by mass or more, and more preferably 25% by mass or more, and more preferably 30% by mass or more, from the viewpoint of ensuring attraction force to the magnet. On the other hand, the content of the magnetic material is preferably 50% by mass or less, and more preferably 45% by mass or less, because the viscosity of the second resin composition is increased as the content of the magnetic material is increased. When the content of the magnetic material in the second resin composition is discussed by the volume fraction, it is preferably 5% by volume or more, and more preferably 7% by volume or more, and more preferably 9% by volume or more, from the point of view of ensuring attraction force to the magnet. Further, it can be preferably 20% by mass or less, and more preferably 15% by mass or less, and more preferably 14% by mass or less, and more preferably 13% by mass or less, and further 12% by mass or less, from the point of view of moldability. Patent Document 3 discloses that it must be 15% or more by volume mixing ratio, but according to results of investigations by the present inventors, it is found that even if it is less than 15% by volume, sufficient attraction force to the magnet can be retained.

The magnetic material includes, for example, in addition to iron powders, particles of ferrite, cobalt, nickel, iron aluminum alloy, iron-cobalt alloy, iron-cobalt-chromium alloy, iron-nickel alloy, iron-nickel-chromium alloy, cobalt-nickel alloy, cobalt-nickel-manganese alloy, nickel-manganese alloy and the like. Illustratively, the magnetic materials may be made of those having an average particle size (D50 based on mass) of 15 to 250 μm.

The ratio by mass of the thermoplastic polyester and the thermoplastic polyester elastomer contained in the second resin composition is also important from the point of view of breakage prevention and co-extrusion moldability of the engaging elements. More particularly, for the reason of effectively preventing any breakage of the engaging element, the blending ratio of the thermoplastic polyester to the thermoplastic polyester elastomer (the thermoplastic polyester/the thermoplastic polyester elastomer) is preferably 50/50 or more, and more preferably 60/40 or more, and more preferably 70/30 or more. Also, for the reason of improving co-extrusion moldability, the ratio of the thermoplastic polyester/the thermoplastic polyester elastomer is preferably 90/10 or less, and more preferably 85/15 or less.

The thermoplastic polyester used in the second resin composition is as mentioned in the first resin composition, and its preferable modes are also equivalent.

On the other hand, the second resin composition uses a thermoplastic polyester elastomer. As used herein, the thermoplastic polyester elastomer refers to a copolymer which is composed of a crystalline hard segment and an amorphous soft segment, the hard segment having a polyester structural unit, and which has heat softening properties.

The polyester structural unit making up the hard segment includes, but not limited to, poly(alkylene terephthalates) such as poly(butylene terephthalate), poly(ethylene terephthalate), and poly(trimethylene terephthalate); poly (alkylene naphthalates) such as poly(butylene naphthalate), poly(ethylene naphthalate), and poly(trimethylene naphthalate); and the like. The polyester structural unit may be used alone or in a combination of two or more of these.

The soft segment can be comprised of, but not limited to, a polyether structural unit such as polyethylene glycol and polypropylene glycol; a polyester structural unit such as an aromatic polyester and an aliphatic polyester, or a polycarbonate structural unit. The structural unit may be used alone or in a combination of two or more of these.

The second composition has a relationship: $Tm_1 \leq Tm_2$, where $Tm_1$ represents a melting point of the thermoplastic elastomer and $Tm_2$ represents a melting point of the thermoplastic polyester, but when $Tm_1$ is excessively lower than $Tm_2$, the fluidity is too high and the moldability is inversely affected. In particular, it has a drawback that the co-extrusion molding with the first resin composition based on the thermoplastic polyester will be difficult. For this reason, it preferably has a relationship of the equation: $Tm_2-40°$ C.$\leq Tm_1 \leq Tm_2$, and more preferably $Tm_2-20°$ C.$\leq Tm_1 \leq Tm_2$.

3. Co-Extrusion Moldability

The molded surface fastener according to the present invention may be produced by co-extrusion molding of the first resin composition and the second resin composition. The production of the molded surface fastener by co-extrusion molding will provide advantages of improving the production efficiency and reducing the production cost. To obtain superior co-extrusion moldability, it is desirable that a ratio ($MVR_2/MVR_1$) of a melt volume rate of the second resin composition ($MVR_2$) to a melt volume rate of the first resin composition ($MVR_1$) is closer. More particularly, the $MVR_2/MVR_1$ is preferably 0.5 or more and 40 or less, and more preferably 1 or more and 30 or less, and further more preferably 1 or more and 20 or less, and typically it can be 10 or more and 30 or less. As used herein, the melt volume rate (MVR) refers to a volume of a polymer melt flowed out at 260° C. for 10 min, as measured according to ISO 1133.

Further, to improve co-extrusion moldability, each MVR at 260° C. of the first resin composition and the second resin composition is preferably 0.3 $cm^3$/10 min or more and 20 $cm^3$/10 min or less, and more preferably 0.4 $cm^3$/10 min or more and 15 $cm^3$/10 min or less, and further more preferably 0.5 $cm^3$/10 min or more and 13 $cm^3$/10 min or less.

(4. Specific Embodiments of the Molded Surface Fastener)

Figure 2:
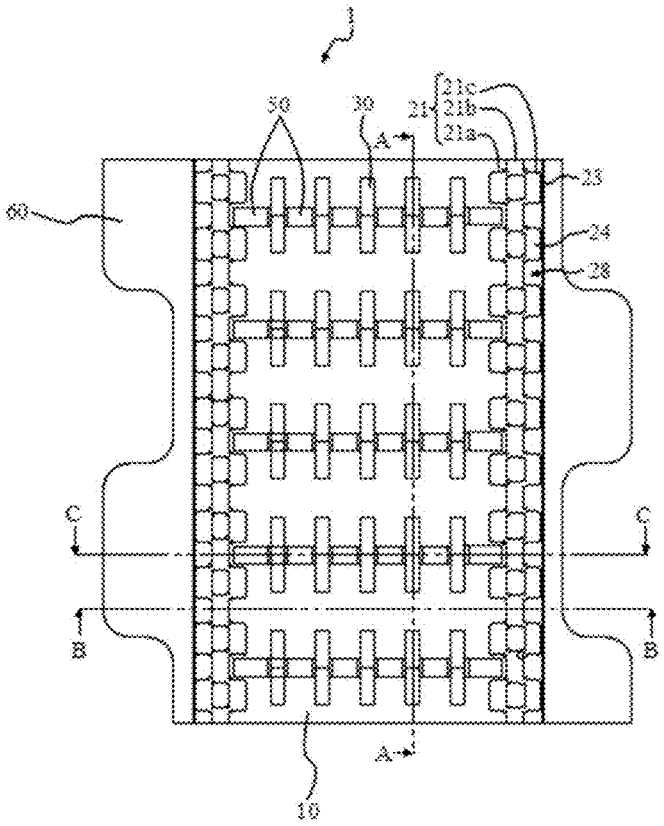
FIG. 2 is a plane view showing the molded surface fastener according to the embodiment of FIG. 1.
Figure 3:
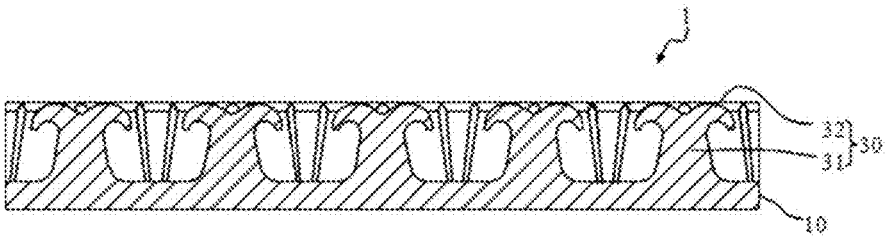
FIG. 3 is a cross-sectional view taken along line A-A of FIG. 2.
Figure 4:
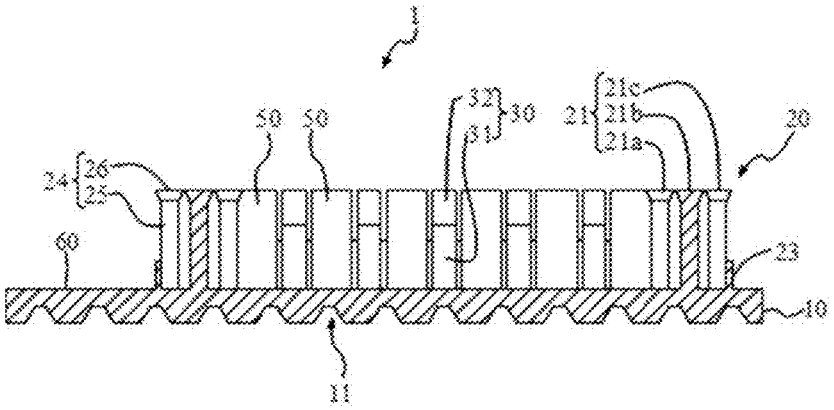
FIG. 4 is a cross-sectional view taken along line B-B of FIG. 2.
Figure 5:
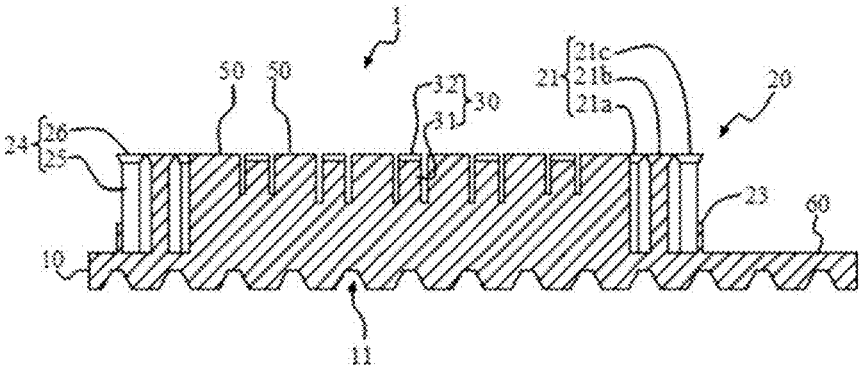
FIG. 5 is a cross-sectional view taken along line C-C of FIG. 2.

Specific Embodiments of the molded surface fastener according to the present invention are now illustrated with reference to Figures. FIG. 1 is a partial perspective view showing a molded surface fastener according to one embodiment of the present invention, and FIG. 2 is a plane view thereof. FIG. 3 is a cross-sectional view taken along line A-A of FIG. 2. FIG. 4 is a sectional view taken along line B-B of FIG. 2. FIG. 5 is a sectional view taken along line C-C of FIG. 2. In the descriptions below, a longitudinal direction is defined as a front-rear direction of the substrate portion of the molded surface fastener, and a width direction of the substrate portion is defined as a left-right direction. Further, a top and bottom direction in the substrate portion is defined as an upward-downward direction, and in particular, a direction of the side where the engaging elements are projected relative to the substrate portion is upward, and a direction of the opposite side is downward.

The molded surface fastener 1 according to one embodiment of the present invention comprises a substrate portion 10 in the form of flat plate; protective wall sections 20 provided on a top surface (a first surface) near right and left side edges on the substrate portion 10; a plurality of engaging elements 30 (hook-shaped engaging elements) placed between the left and right protective wall sections 20; and lateral wall sections 50 arranged along a width direction; and fin pieces 60 extended outwardly in a wide direction from the right and left side edges of the substrate portion 10.

The substrate portion 10 is formed by reducing a plate thickness so that the molded surface fastener 1 can be bended in the upward-downward direction. On the upper side of the substrate portion 10, a flat surface is formed between the engaging elements 30 arranged at a predetermined mounting pitch in the longitudinal direction. On the other hand, on the underside of the substrate portion 10, longitudinally parallel concave groove portions 11 (or ridges) are formed in order to increase the bonding areas between the molded surface fastener 1 and the foam to enhance the fixing strength when integrally molding the molded surface fastener 1 with the cushion body. At least a part of the underside of the substrate portion 10 is made of the first resin composition, thereby allowing the adhesion to the cushion body to be retained.

The presence of left and right protective wall sections 20 can prevent the foaming resin material from entering regions for forming the engaging elements during foam molding of the cushion body. The Left and right protective wall sections 20 are arranged at positions near the side edges, which are slightly inward from the left and right side edges of the substrate portion 10. Each of left and right protective wall sections 20 comprises three-row longitudinal wall sections 21 disposed along the longitudinal direction; connecting sections 22 for connecting the longitudinal wall sections 21 arranged in adjacent rows; and reinforcement sections 23 arranged on the outer wall surface side of the outermost longitudinal wall sections 21. The longitudinal wall section 21 of each row comprises a plurality of longitudinal walls 24 intermittently arranged at a predetermined mounting pitch in the longitudinal direction, and gaps 28 are provided between the two longitudinal walls 24 adjacent in the longitudinal direction.

In this embodiment, the longitudinal wall sections 21 arrayed in a row closest to the side of the engaging elements 30 refer to first row longitudinal wall sections 21*a*; the longitudinal wall sections 21 arrayed in a row arranged outside the first row 21*a* refer to second row longitudinal wall sections 21*b*; and the longitudinal wall sections 21 arrayed in an outermost row refer to third row longitudinal wall sections 21*c*.

In the left and right protective wall sections 20, the mounting pitch in the longitudinal direction of each longitudinal wall 24 to be arranged on each row longitudinal wall section 21 is set to a value of ½ of the mounting pitch in the longitudinal direction of the engaging elements 30 described below. Further, the longitudinal walls 24 in the first-third row longitudinal wall sections 21*a*-21*c* are arranged in a zigzag pattern so as to be a staggered positional relationship in each row, and in particular, the first row longitudinal wall section 21*a* and the second row longitudinal wall section 21*b*, as well as the second row longitudinal wall section 21*b* and the third row longitudinal wall section 21*c* are configured to respectively stagger longitudinally each other at a value of ½ of the mounting pitch.

Furthermore, in the present invention, the mounting pitch in the longitudinal direction of the longitudinal walls arranged on each row longitudinal wall section may be set to a value of ½ or less of the mounting pitch in the longitudinal direction of the engaging elements. The setting of the mounting pitch of the longitudinal walls in such a manner can shorten a size in the longitudinal direction of each longitudinal wall and provide two or more gaps between the longitudinal walls of the longitudinal wall sections in each row per the mounting pitch of the engaging elements, thereby further improving flexibility of the molded surface fastener.

On the other hand, when the mounting pitch of the longitudinal walls is too small, arrangement density of the connecting portion for connecting the longitudinal walls of the adjacent rows is rather too large and may impair the flexibility of the molded surface fastener. Therefore, the mounting pitch of the longitudinal wall sections arranged in each row is preferably set to a value of ¼ or more of the mounting pitch of the engaging elements.

Each longitudinal wall 24 comprises a pillar portion 25 rising from the substrate portion 10 and a top surface portion 26 disposed at the top of the pillar portion 25, the height of each longitudinal wall 24 with respect to the substrate portion 10 (dimension in the upward-downward direction) is set to the same dimension as the height of the engaging element 30 with respect to the substrate portion 10.

The pillar portion 25 of each longitudinal wall 24 is formed in a quadrangular pyramid shape elongated in the longitudinal direction, and the inner wall surface and the outer wall surface (left and right side wall surfaces) of the pillar portion 25 are configured in a positional relation parallel to each other. Further, the front wall and the rear wall of the pillar portion 25 is configured to incline to the upward-downward direction such that the longitudinal dimension of the pillar portion 25 gradually decreases upward, and the pillar portion 25 presents a substantially trapezoidal shape when viewed from the left and right side wall surface sides.

The top surface portion 26 of each longitudinal wall 24 is formed to protrude from the top of the pillar portion 25 in the longitudinal direction and in the width direction, and the top of the top surface portion 26 is formed in a flat form. By having such a top surface portion 26 on the longitudinal wall 24 configured in the longitudinal wall section 21 of each row, the contact area between the longitudinal wall sections 21 (longitudinal walls 24) of the molded surface fastener 1 and the mold can be increased, thereby improving the adhesion between the molding surface fastener 1 and the mold, when placing the molded surface fastener 1 within the mold for the cushion body such that the top surfaces on which the engaging elements 30 of the molded surface fastener 1 are arrayed are in contact with the surface of the mold.

Fin pieces 60 are extended in a tongue shape outwardly from the left and right side edges of the substrate portion 10, and the left fin pieces 60 and the right fin pieces 60 are alternately arranged at a predetermined mounting pitch in the longitudinal direction. The top surfaces of the left and right fin pieces 60 are disposed in the same plane as the top surface of the substrate portion 10, and on the bottom surface of the fin pieces 60, a plurality of concave groove portions 11 (or ridges) parallel to the longitudinal direction are formed as with the bottom surface sides of the substrate portion 10. These left and right fin pieces 60 are parts which will be embedded within the cushion body during foam molding of the cushion body, and will serve to firmly secure the molded surface fastener 1 to the cushion body.

The connecting portion 22 is configured so as to connect a front end portion provided on the longitudinal wall 24 in the longitudinal wall section 21 of each row to a rear end portion provided on the longitudinal wall 24 in the longitudinal wall section 21 of the row adjacent to the former row, together. That is, the connecting portion 22 connects the front end portion of the longitudinal wall 24, provided on the first row longitudinal wall section 21*a* and the third row longitudinal wall section 21*c*, to the rear end portion of the longitudinal wall 24, provided on the second row longitudinal wall section 21*b*, and connects the front end portion of the longitudinal wall 24, provided on the second row longitudinal wall section 21*b*, to the rear end portion of the longitudinal wall 24, provided on the first row longitudinal wall section 21*a* and the third row longitudinal wall section 21*c*. In this case, each connecting portion mutually connects a corner portion (front edge) on the front wall side of the longitudinal wall 24 arranged in each row to a corner portion (rear edge) on the rear wall side of the longitudinal wall 24 arranged in a row adjacent to the former row.

By having such a connecting part 22, two longitudinal walls 24 standing side by side in the longitudinal wall sections 21 of the adjacent rows become connected to one longitudinal wall 24. (The longitudinal wall 24 arrayed in the second row longitudinal wall section 21*b* is connected via the connecting portion 22 to the two longitudinal walls 24 arrayed in the first row longitudinal wall section 21*a* and the two longitudinal walls 24 arrayed in the third row longitudinal wall section 21*c*, thereby in a state of being connected to the four longitudinal walls 24 in total.)

Since the connecting portions 22 are arranged in the protective wall sections 20 as described above, within the range of height dimension in which the protective wall sections 20 stand, the external side of the protective wall sections 20 (i.e., the region sides where the cushion body is molded) and the inner side where the engaging elements 30 are arranged (i.e., the side of the engaging element formed region) can be completely separated by both the longitudinal wall sections 21 and the connecting portions 22. This can reliably prevent the foaming resin material from entering the inner side from the external side of the protective wall sections 20 beyond the protective wall sections 20, when foam molding the cushion body.

The engaging elements 30 as described above stand at a predetermined mounting pitch in the longitudinal direction and in the width direction, so as to obtain desirable coupling force (engaging force) with the loop-shaped engaging elements arranged on the covering material for covering the cushion body. The engaging elements 30 according to this embodiment are arrayed in rows at a predetermined mounting pitch in the longitudinal direction, as well as their rows of the engaging elements 30 are arrayed in five rows in the width direction, whereby the engaging element formed region is formed. Each engaging element 30 comprises a stem portion 31 perpendicularly standing from the top surface of the substrate portion 10 and a hook-shaped engaging head 32 extended from the upper end of the stem portion 31 while bending forward or backward. The shape, dimension, mounting pitch and the like of the engaging element 30 are not particularly limited and can be changed as needed.

At least a part of the engaging elements 30 as described above is made of the second resin composition. The engaging elements 30 molded from the second resin composition may be resistant to breakage of the engaging elements 30 due to attachment and detachment handlings of the surface fastener. Also, the magnetic material contained in the second resin composition allows the molded surface fastener 1 to be attracted to the magnet.

The lateral wall sections 50 as described above are arranged along the width direction between the second row longitudinal wall sections 21*b* in the protective wall sections 20 and the engaging elements 30 of the left end or right end, and between the engaging elements 30 adjacent to each other in the width direction. In each lateral wall section 50, its generally lower half part is connected to that of the engaging element 30 adjoiningly disposed, thereby reinforcing the lateral wall section 50 and the engaging element 30 together.

In the molded surface fastener 1 according to the present embodiment, the height dimensions of the longitudinal walls 24, connecting portions 22, lateral wall sections 50 and engaging elements 30 from the substrate portion 10 are all set to the same dimensions, and these top surfaces or upper ends are arranged in the same plane. Thus, when placing the molded surface fastener 1 within the mold for the cushion body such that the top surface with the engaging elements 30 arranged is in contact with the surface of the mold, during the foam molding of the cushion body, the contact area between the molded surface fastener 1 and the mold is increased. This can prevent the foaming resin material from entering the engaging element formed region from the width direction beyond the longitudinal wall sections 21, while preventing it from entering from the longitudinal direction beyond the lateral wall sections 50 and the engaging elements 30.

Figure 6A:
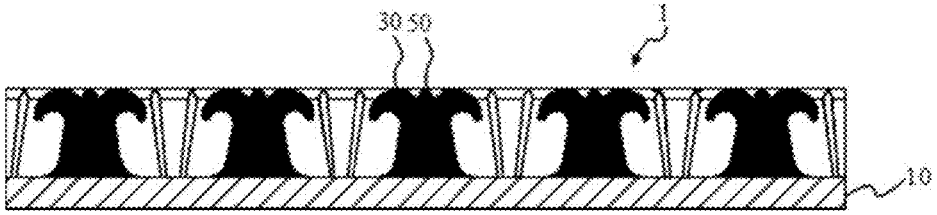
FIG. 6 (*a*) shows parts made of the second resin composition in the molded surface fastener according to one embodiment of the present invention, using a sectional view corresponding to FIG. 3.
Figure 6B:
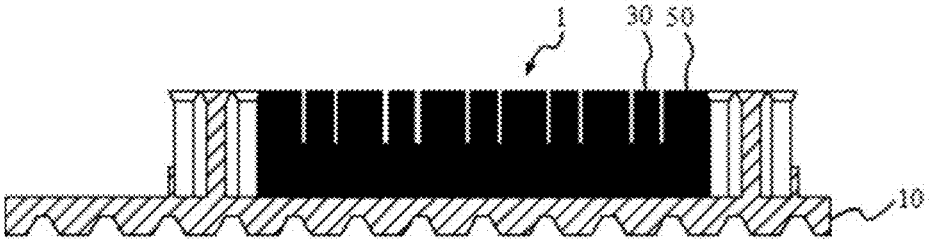
Figure 6C:
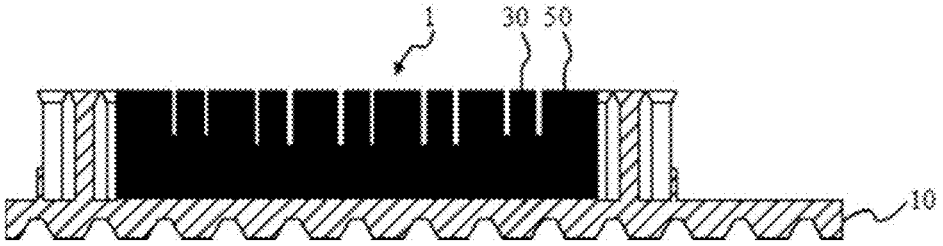
Figure 7A:
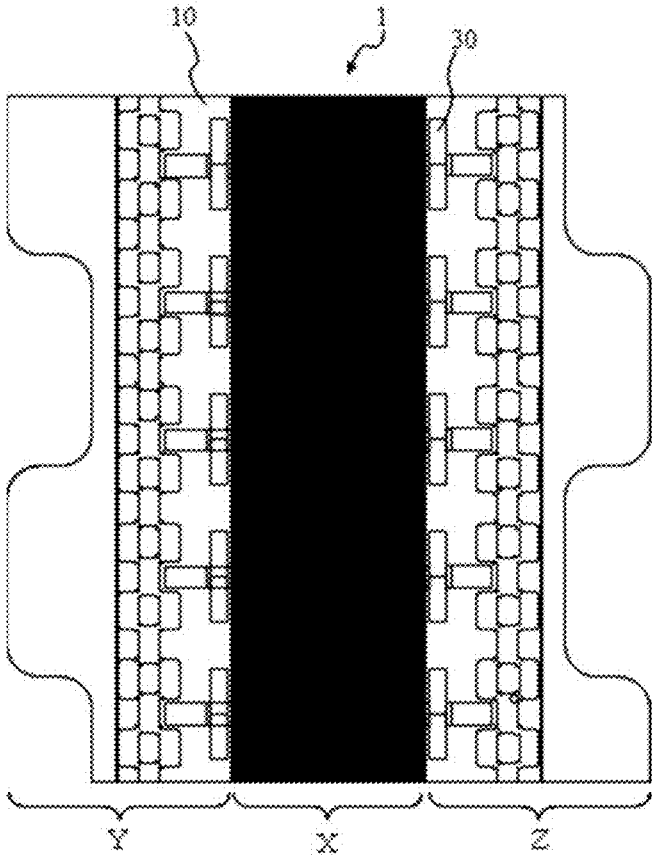
FIG. 7 (*a*) shows parts made of the second resin composition in the molded surface fastener according to another one embodiment of the present invention, using a top view corresponding to FIG. 2.
Figure 7B:
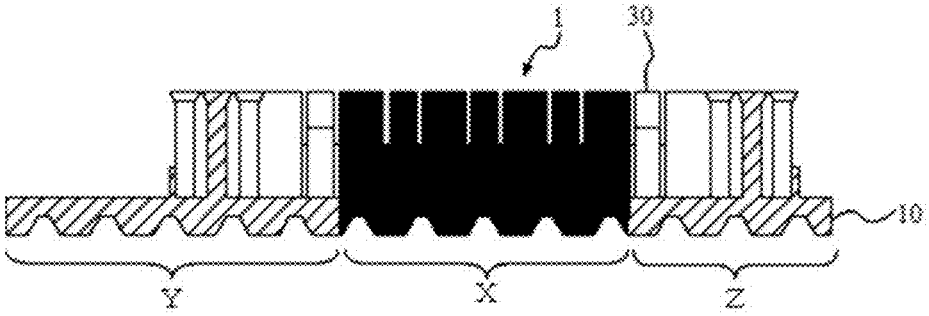
Figure 7C:
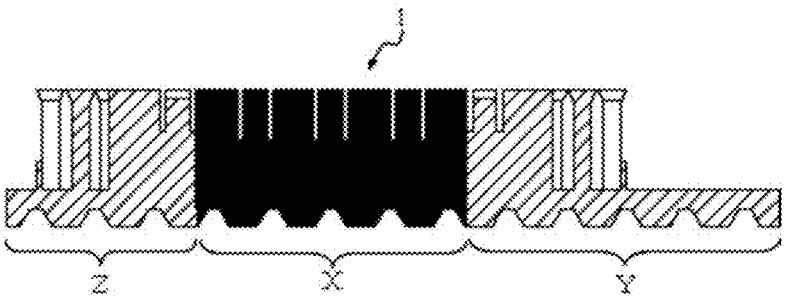
Figure 8A:
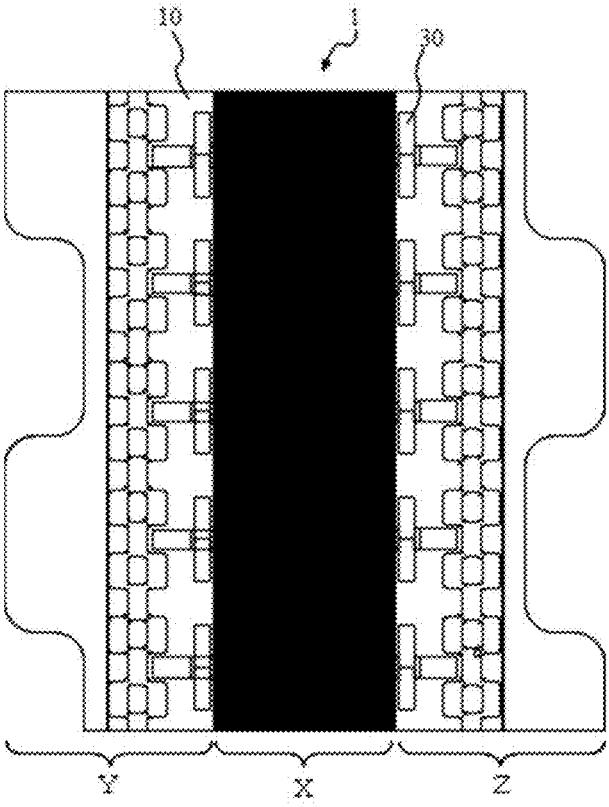
FIG. 8 (*a*) shows parts made of the second resin composition in the molded surface fastener according to further another one embodiment of the present invention, using a top view corresponding to FIG. 2.
Figure 8B:
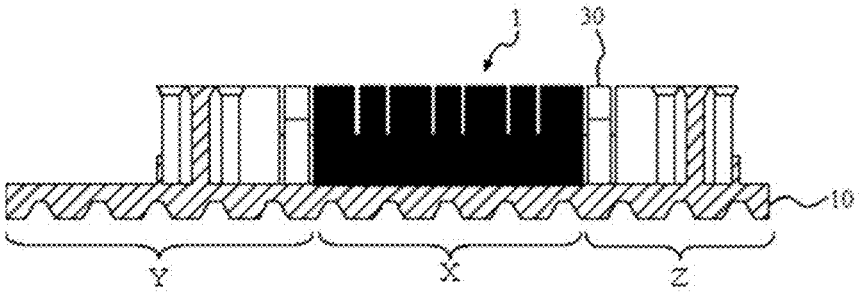
Figure 8C:
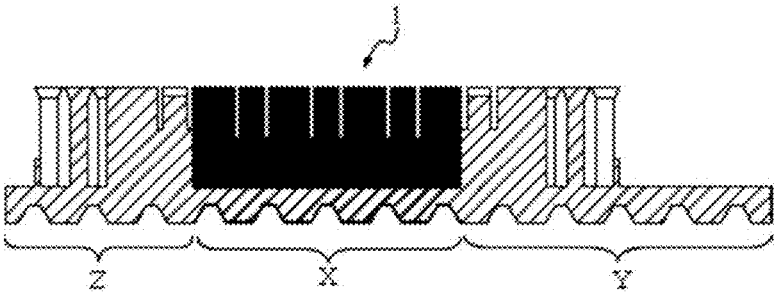

The molded surface fastener 1 having the structure as described above can be manufactured as an integral molded article of the first resin composition and the second resin composition. The place where the first resin composition and the second resin composition are located in the molded surface fastener 1 may be set as needed according to the guidelines previously described, but some embodiments are illustrated with reference to FIGS. 6 to 8. In FIGS. 6 to 8, parts made of the second resin composition are painted in black.

First, the embodiment of FIG. 6 is described. FIG. 6 (*a*) represents a cross section corresponding to FIG. 3, FIG. 6 (*b*) represents a cross section corresponding to FIG. 4, and FIG. 6 (*c*) represents a cross section corresponding to FIG. 5. In the embodiment of FIG. 6, the substrate portion 10 is completely made of the first resin composition. Thus, high adhesion between the molded surface fastener 1 and the cushion body can be ensured. Further, in the embodiment of FIG. 6, all the protective wall sections 20 are made of the first resin composition. Since the protective wall sections 20 are parts contacted with the cushion body as with the substrate portion 10, the protective wall sections 20 are made of the first resin composition, thereby providing improved adhesion between the molded surface fastener 1 and the cushion body.

In the embodiment of FIG. 6, all the engaging elements 30 are made of the second resin composition. Thus, anti-cracking performance is higher during attachment and detachment to and from the loop-shaped engaging elements arranged on the covering material covered over the cushion body, and higher attraction force to the magnet can be ensured. Then, since all the engaging elements 30 are made of the second resin composition, the magnetic material will be disposed over the full length of the molded surface fastener 1 along the longitudinal direction. Therefore, when placing the molded surface fastener 1 onto the surface of the mold for the cushion body, the molded surface fastener 1 can be fixed by magnetic force of the magnet installed within the mold such that the front-rear direction of the molded surface fastener 1 can be automatically oriented to be consistent with the magnetic pole direction of the magnet.

In the present invention, the function in which the molded surface fastener is thus automatically oriented by magnetic force is referred to as a self-alignment property. The improving of the self-alignment property provides an advantage of increasing work efficiency when placing the molded surface fastener onto the surface of the mold for the cushion body. In the embodiment of FIG. 6, the lateral wall sections 50 are also completely made of the second resin composition. By also forming the lateral wall sections 50 from the second resin composition, advantages of improving attraction force to the magnet and the self-alignment property of the magnet are obtained and the molding is also facilitated.

Next, the embodiment of FIG. 7 is described. FIG. 7(*a*) represents a plane view corresponding to FIG. 2, FIG. 7(*b*) represents a cross section corresponding to FIG. 4, and FIG. 7(*c*) represents a cross section corresponding to FIG. 5. In the embodiment of FIG. 7, the molded surface fastener 1 is composed of three regions: a central part X having boundary lines along its longitudinal direction and left and right side parts Y and Z thereof, and each of these three regions has the substrate portion 10 and the engaging elements 30, and for the central part X, both the substrate portion 10 and the engaging elements 30 are made of the second resin composition, and for the right and left side parts Y and Z, both the substrate portion 10 and the engaging elements 30 are made of the first resin composition. Thus by forming only the central part X in the longitudinal direction from the second resin composition, when the magnetic material is extended in a narrow fashion in the longitudinal direction within the molded surface fastener 1, the front-rear direction of the molded surface fastener 1 is easily matched to the magnetic pole direction of the magnet when approaching the molded surface fastener 1 to the magnet, namely an advantage of improving the self-alignment property is obtained.

A range in the width direction of the central part may be set as needed taking magnetic force between the magnetic material placed in the molded surface fastener 1 and the magnet into account, and is not particularly limited. However, from the viewpoint of improving the self-alignment property, it is sufficient to configure the second resin composition so as to have a narrower width than the width of the magnet which is not shown, and the range in the width direction of the central part X is that including preferably the number of 80% or less, more preferably the number of 70% or less of the engaging elements 30 aligned in the width direction on the substrate portion 10 of the molded surface fastener 1. On the other hand, since a broader range in the width direction of the central part X increases attraction force to the magnet and an increased proportion of the second resin composition used in the engaging elements 30 improves effects of preventing breakage of the engaging elements 30 due to attachment and detachment handlings of the fastener, the range in the width direction of the central part X is that including preferably the number of 30% or more, more preferably the number of 40% or more, further more preferably the number of 50% or more of the engaging elements 30 aligned in the width direction on the substrate portion 10 of the molded surface fastener 1.

Finally, the embodiment of FIG. 8 is described. FIG. 8 (*a*) shows a plan view corresponding to FIG. 2, FIG. 8 (*b*) shows a cross section corresponding to FIG. 4, and FIG. 8 (*c*) shows a cross section corresponding to FIG. 5. The embodiment of FIG. 8 is the same as the embodiment of FIG. 7, except that for the central part X, the substrate portion 10 is made of the first resin composition, and the engaging elements 30 are made of the second resin composition, and the preferable range in the width direction of the central part X is also the same. According to this embodiment, since the entire bottom surface of the substrate portion 10 is made of the first resin composition, it provides an advantage of improving adhesion to the cushion body as compared to the embodiment of FIG. 7. Further, the proportion of the second resin composition used in the molded surface fastener 1 is decreased, which will also contribute to reduction of production cost.

(5. Producing Method)

The molded surface fastener according to the present invention may be produced according to any known method that can integrally mold different types of resin compositions, including, as representative examples, a double molding method allowing integration by two steps of forming a first molded product and then forming a second molded product; and a co-extrusion molding method in which two types of molten resin compositions are simultaneously extruded using two extrusion ports.

Figure 9A:
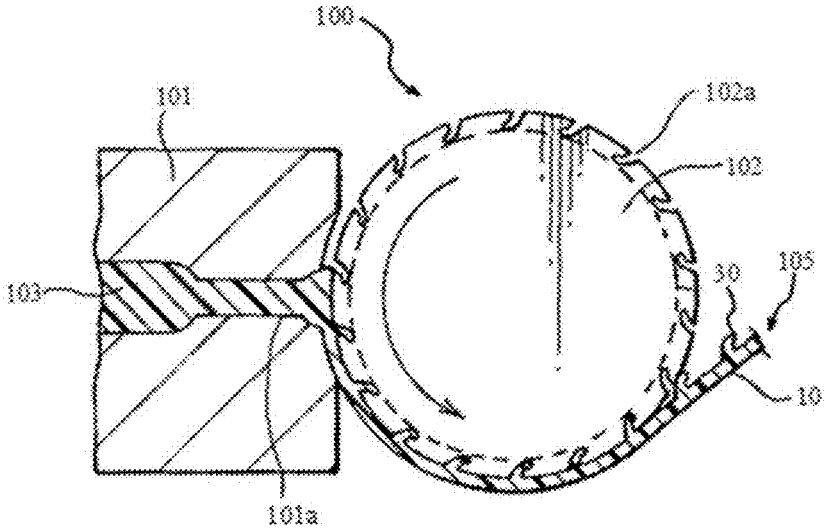
FIG. 9 (A) is a schematic diagram of a production device for a first molded product when producing a molded surface fastener by a double molding method.
Figure 9B:
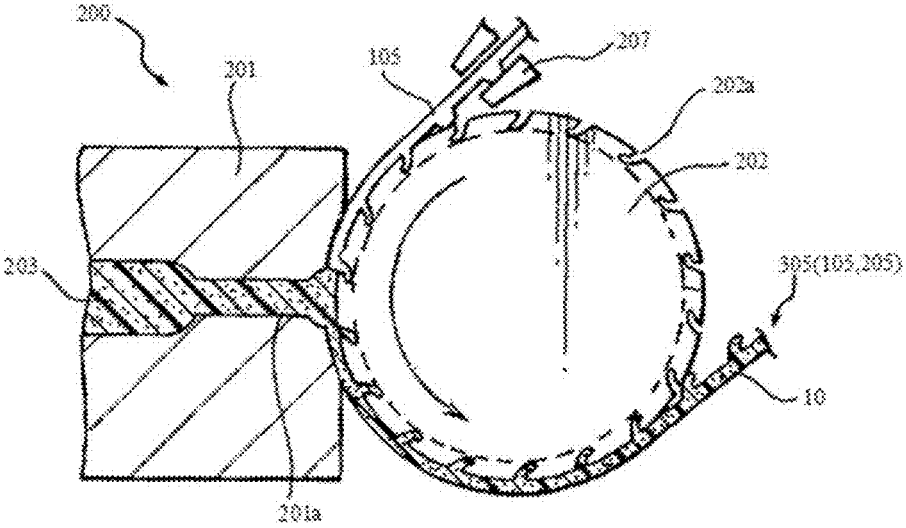

In a case of producing the molded surface fastener according to the present invention by the double molding method, production devices 100 and 200 shown in FIGS. 9 (A) and 9 (B) can be used for example. The double molding method provides an advantage of allowing the integral molding even if the first resin composition and the second resin composition are significantly different in their fluidities and they are not suitable for the co-extrusion molding.

First, as shown in FIG. 9 (A), a first die wheel 102 is disposed to face a first extrusion port 101*a* in a first extrusion die 101. The first die wheel 102 is rotated in the arrow direction about an axis of rotation perpendicular to the paper surface in FIG. 9(A). On the rotational peripheral surface of the first die wheel 102, molding cavities 102*a* for a part of the engaging elements 30 are formed. Cavities for forming other sections such as the protective wall sections 20 and the lateral wall sections 50 may be also provided on the die wheel 102, although they are not shown. A clearance is formed between the first extrusion die 101 and the first die wheel 102, and a molten synthetic resin 103 (e.g. the second resin composition) is continuously pushed out from the extrusion port 101*a* toward the rotational peripheral surface of the first die wheel 102. In this case, the molten resin pushed out to the peripheral surface of the first die wheel 102 is continuously forming the substrate portion 10 of a part of the molded surface fastener in the clearance between the extrusion port 101*a* in the first extrusion die 101 and the first die wheel 102, while at the same time forming a part of the engaging elements 30 at the molding cavities 102*a* as described above. Then, a long first molded product 105 having a part of the substrate portion 10 and a part of the engaging elements 30 is removed off from the first die wheel 102 using a pickup roller (not shown).

Then, as shown in FIG. 9 (B), a second die wheel 202 is disposed to face an extrusion port 201*a* in a second extrusion die 201. The second die wheel 202 is rotated in the arrow direction about an axis of rotation perpendicular to the paper surface in FIG. 9 (B). On the rotational peripheral surface of the second die wheel 202, molding cavities 202*a* for the remaining engaging elements 30 are formed. Further, on the rotational peripheral surface of the second die wheel 202, accommodating recesses (not shown) for accommodating the first molded product 105 previously molded are provided, and the first molded product 105 is continuously supplied into the accommodating recesses via guide portions 207. After the first molded product 105 is thus accommodated in the accommodating recesses on the rotational peripheral surface of the second die wheel 202, a molten synthetic resin 203 (e.g., the first resin composition) is continuously pushed out from an extrusion port 201*a* toward the rotational peripheral surface of the second die wheel 202. The molten resin pushed out on the peripheral surface continuously forms the remaining substrate portion 10 of the molded surface fastener in the clearance between the extrusion port 201*a* in the second extrusion die 201 and the second die wheel 202, while at the same time forming the remaining engaging elements 30 at the molding cavities 202*a* as described above. Cavities for forming other sections such as the protective wall sections 20 and the lateral wall sections 50 may be also provided on the die wheel, although they are not shown. Then, a molded product 305 in which the first molded product 105 and the second molded product 205 have been integrated is removed off from the second die wheel 202 using a pickup roller (not shown), and fin pieces 60, concave groove portions 11 or the like are then shaped as required, whereby a long molded surface fastener can be produced. The long molded surface fastener can be cut into a desirable length and used.

Figure 10A:
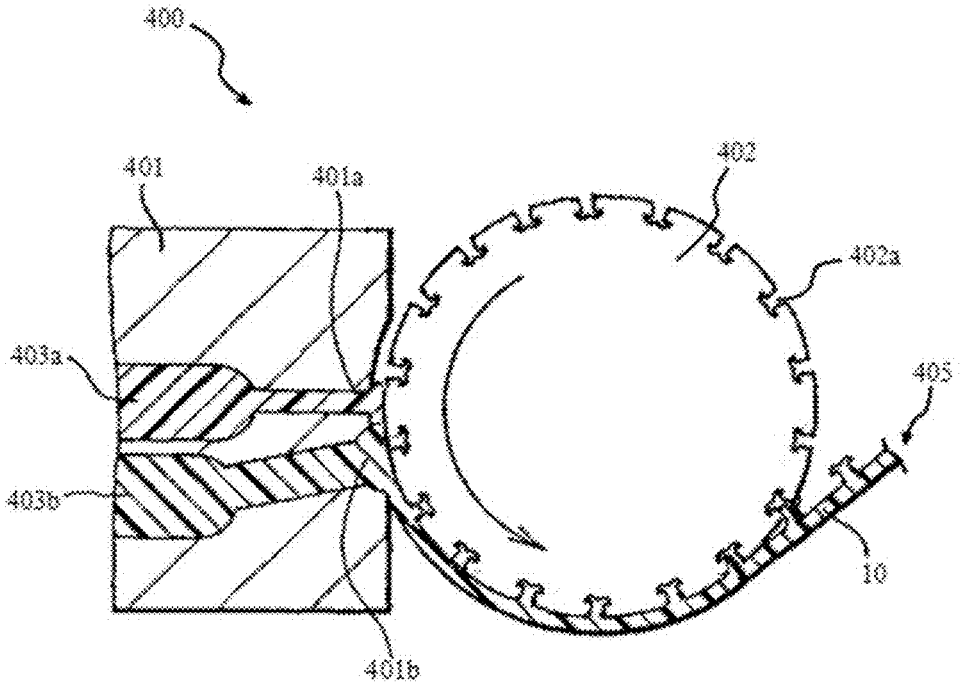
FIG. 10 (A) is a schematic view of a production device when producing a molded surface fastener by a co-extrusion molding.
Figure 10B:
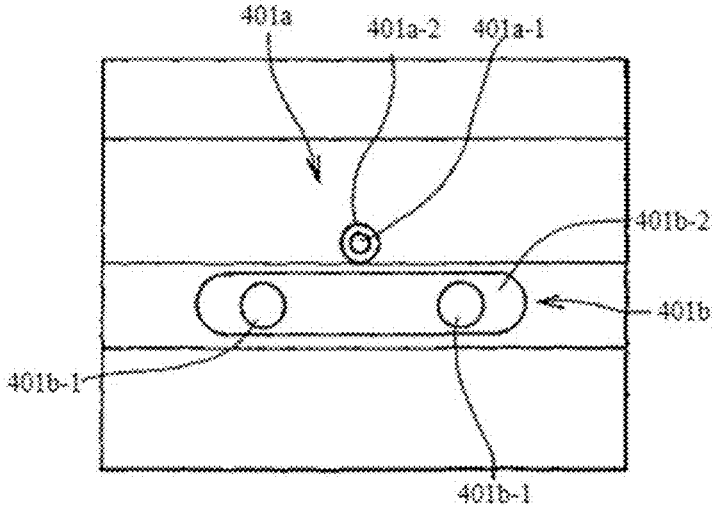
Figure 11:
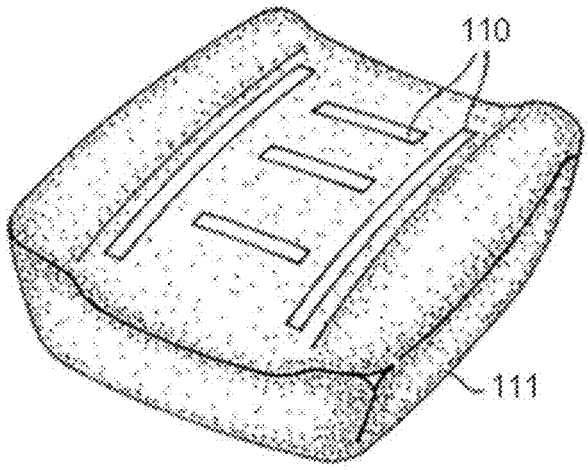
FIG. 11 is a perspective view of a cushion body that integrally fixes the molded surface fastener.
Figure 12:
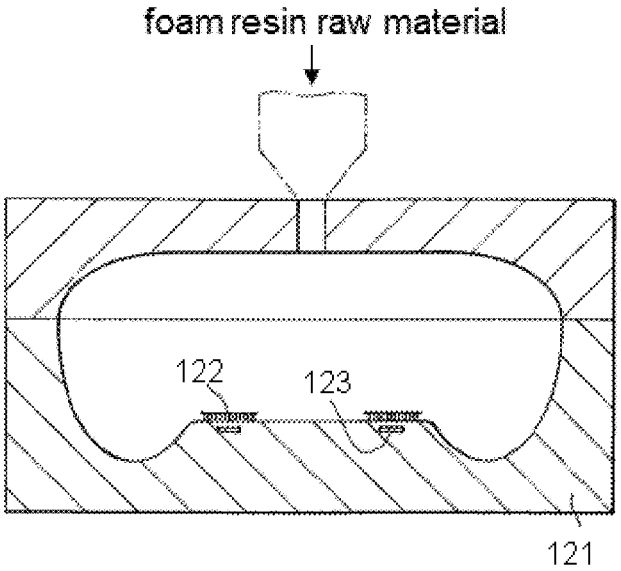
FIG. 12 is a cross-sectional view showing the state of the inside of a mold for the cushion body with the molded surface fastener placed.

In a case of producing the molded surface fastener 1 according to the present invention by the co-extrusion molding method, a production device 400 having two extrusion ports 401*a* and 401*b* can be used, as shown in FIGS. 10 (A) and 10 (B), for example. The co-extrusion molding method provides an advantage of giving high production efficiency because different resin compositions can be integrally molded by a single molding process.

In the production device 400, extrusion ports 401*a* and 401*b* are provided in the upper and lower positions of the extrusion die 401, each of the two extrusion ports 401*a*, 401*b* can extrude the separate synthetic resin material. As shown in FIG. 10 (A), a die wheel 402 is disposed so as to face the extrusion ports 401*a*, 401*b* in the extrusion die 401. The die wheel 402 is rotated in the arrow direction about an axis of rotation perpendicular to the paper surface in FIG. 10 (A). On the rotational peripheral surface of the die wheel 402, the cavities for the first molded product as stated above are formed, as well as the cavities for the second molded product as stated above are formed. For simplicity, in this figure, the cavities for the first and second molded products are collectively indicated as 402*a*.

As shown in FIG. 10 (B), at the distal end of the extrusion port 401*a* at the upper position, a nozzle portion 401*a*-1 and a recess 401*a*-2 are formed. As a result that the recess 401*a*-2 is formed, a synthetic resin 403*a* (e.g. the second resin composition) extruded from the nozzle portion 401*a*-1 can spread in the recess 401*a*-2, thereby easily filling the entire surface of the cavity for the first molded product in the die wheel 402 with the synthetic resin 403*a*. Also, at the distal end of the extrusion port 401*b* at the lower position, nozzle portions 401*b*-1 and a recess 401*b*-2 around the nozzle portions are formed at the distal end of the extrusion port 401*b*. A synthetic resin 403*b* (e.g. the first resin composition) extruded from the nozzle portions 401*b*-1 can spread in the recess 402*b*-2, thereby easily filling the entire surface of the cavity for the second molded product with the synthetic resin 403*b*.

While rotating the die wheel 402 in the arrow direction, the synthetic resin 403*a* in a molten state is extruded from the extrusion port 401*a* and continuously charged within the cavity for the first molded product. At this time, the substrate portion 10 of a part of the molded surface fastener is also continuously formed in a clearance between the extrusion port 401*a* and the die wheel 402, located at the upper position in the extrusion die 401. The first molded product is produced in this manner. Also, at the same time, the synthetic resin material 403*b* in a molten state is extruded from the extrusion port 401*b* and continuously charged within the cavity for the second molded product over the first molded product which has been already prepared. At this time, the remaining substrate portion 10 of the molded surface fastener is also continuously formed in the clearance between the extrusion port 401*b* and the die wheel 402, located at the lower position in the extrusion die 401. Then, a molded product 405 in which the first molded product and the second molded product have been integrated is removed off from the die wheel 402 using a pickup roller (not shown), and subsequently fin pieces 60, concave groove portions 11 or the like are then shaped as required, whereby a long molded surface fastener can be produced. The long molded surface fastener can be cut into a desirable length and used.

EXAMPLES

Examples of the present invention are illustrated below, but they are provided for a better understanding of the present invention and its advantages, and are not intended to limit the present invention.

(1. Materials)

In the following test examples, the following materials were used:

<First Resin Composition>

A thermoplastic polyester (a PBT resin with a melting point=224° C., available from Toray Industries, Inc., under the trade name of TORAYCON® 5201X11);

<Second Resin Composition>

A thermoplastic polyester (a PBT resin with a melting point=224° C., available from Toray Industries, Inc., under the trade name of TORAYCON® 1401×04);

A thermoplastic polyetherester elastomer (a block copolymer of PBT (a hard segment) and a polyether (a soft segment), with a melting point=208° C., available from DU PONT-TORAY Co., Ltd., under the trade name of Hytrel® 5557);

A thermoplastic polyetherester elastomer (a block copolymer of PBT (a hard segment) and a polyether (a soft segment), with a melting point=164° C., available from DU PONT-TORAY Co., Ltd., under the trade name of Hytrel® 2551);

A thermoplastic polyester elastomer (a block copolymer of PBT (a hard segment) and an aliphatic polyester (a soft segment), with a melting point=206° C., available from TOYOBO Co., Ltd., under the trade name of PELPRENE® S 2001);

A thermoplastic polyurethane elastomer (a block copolymer of a polyurethane (a hard segment) and a polyester (a soft segment), with a softening point=120 to 150° C., available from BASF Japan Co., Ltd., under the trade name of Elastollan® ET690);

Magnetic material (iron powders with an average particle size of 40 μm).

(2. Fluidity Test)

The materials constituting the second resin composition were blended in a mass ratio in accordance with the test number shown in Table 1, and melt-mixed under a condition of a cylinder temperature of 260° C. and a rotation speed of 100 rpm using a biaxial extruder PCM45 from Ikegai Tekko Ltd., and a MVR (Melt Volume Rate) was measured at 260° C. according to ISO 1133 using Melt Indexer F-F01 from TOYO SEIKI KOGYO CO. LTD. Results are shown in Table 1. In this table, "OVER" indicates that measurement was not possible because a large amount of sample was discharged due to the high fluidity. In addition, the MVR for the first resin composition is also listed as a reference example.

(3. Continuous Extrusion Molding of Surface Fastener)

For Examples 1-4 and Comparative Example 2, the surface fastener in the shape shown in FIG. 1 was continuously integrally molded by mixing the materials used for the second resin composition at a mass ratio indicated in Table 1 according to the test number, and then co-extruding the first resin composition and the second resin composition at a temperature of 260° C. using the co-extruder. In this case, the whole substrate portion was made of the first resin composition, and the whole engaging elements were made of the second resin composition. The volume ratio of the first resin composition and the second resin composition contained in the surface fastener was the first resin composition: the second resin composition=3:2.

Also, for Comparative Examples 1 and 3 as well as Reference Example, the surface fastener in the shape shown in FIG. 1 was continuously integrated by extrusion molding at a temperature of 260° C. using an extruder having a single extrusion nozzle, because only a single resin composition was used for the surface fastener. In this case, for the surface fastener produced, both the substrate portion and the engaging elements were made of the same resin composition.

As status during extrusion molding of the surface fastener according to each test example, a case where a mold release failure occurs because fluidity of the second resin composition is too high (which results in the variation in the hook shapes of the engaging elements) and a case where a discontinuous molded product is produced because fluidity of the second resin composition is too low (non-filling in the engaging elements occurs) are indicated as "poor", and other cases indicated as "good" or "pass". Results are shown in Table 1.

(4. Single Hook Hanging Test)

The surface fastener according to each test example obtained by continuous extrusion molding was tested for a single hook hanging test to evaluate the strength and the presence or absence of cracks on the engaging elements. The single hook hanging test was performed by horizontally placing the surface fastener (length of 50 mm×width of 15 mm) such that the surface with engaging elements formed is on the top, and fixing it to a fixture, and then selecting any one engaging element, hanging a loop on such an engaging element, and measuring the maximum strength when the hook was pulled just above until the loop was released from the hook at a rate of 300 mm/min with a tensile testing machine from Instron. Results are shown in Table 1. The engaging element was observed for the presence or absence of cracks with an optical microscope, and a case where no crack was observed was evaluated as "absence", and a case where cracks occurred was evaluated as "presence".

In addition, a case where the rotation direction of the die wheel is opposite to the direction of the hook in the engaging head when the engaging element is released from the cavity is referred to as a "positive releasing", and a case where the rotational direction of the die wheel is matched to the direction of the hook in the engaging head when the engaging element is released from the cavity is referred to as a "reverse releasing". Generally, the "reverse releasing" applies stronger stress to the engaging element than the "positive releasing" during mold release, and is thus more susceptible to damage to the engaging element. Therefore, for the value of the single hook hanging test, the strength in the side of the opposite releasing tends to be lower.

(5. Test for Attraction to Magnet)

Attraction to magnet was tested for the surface fastener according to each test example obtained by the continuous extrusion molding. The test for attraction to magnet was performed by fixing the surface fastener (a length of 50 mm×a width of 15 mm) to a fixture using a double sided tape such that the surface with the engaging elements formed was exposed, then approaching it to the fixture with magnets embedded and attracting them, and measuring the maximum strength when pulling them until the magnet was released from the surface fastener at a rate of 10 mm/min with a tensile testing machine from Instron. In this test, attraction force of 1.0 N or more would not generate any practical problem.

(6. Discussion)

In Comparative Example 1, cracks were formed by the single hook hanging test because no thermoplastic polyester elastomer was formulated in the second resin composition making up the engaging element. Also, there are disadvantages of insufficient adhesion to the cushion body and increased material cost because the substrate portion is also made of the second resin composition. Comparative Example 2 blended the thermoplastic elastomer in the second resin composition, but the co-extrusion molding was not possible because the thermoplastic elastomer was a polyurethane elastomer and its softening temperature was too low.

In Comparative Example 3, the viscosity was excessively high because an amount of iron powder incorporated was too high, and the molding was not possible.

Reference example is the result when forming the surface fastener from only the thermoplastic polyester, but since it contains no magnetic material, it does not achieve the object of giving attraction force to the magnet to the surface fastener.

TABLE 1

| | | | Example 1 | Example 2 | Example 3 | Example 4 | Comp. 1 | Comp. 2 | Comp. 3 | Ref. Example |
|---|---|---|---|---|---|---|---|---|---|---|
| First Resin Composition | Thermoplastic Polyester | TORAYCON 5201X11 (Melting Point = 224° C.) | 100% | 100% | 100% | 100% | | 100% | | 100% |
| Second Resin Composition | Thermoplastic Polyester | TORAYCON 1401X04 (Melting Point = 224° C.) | 48% | 36% | 48% | 48% | 60% | 36% | 30% | |
| | Thermoplastic Elastomer | Hytrel 5557 (Melting Point = 208° C.) | 12% | 24% | | | | | | |
| | | Hytrel 2551 (Melting Point = 164° C.) | | | | 12% | | | | |
| | | PELPRENE S2001 (Melting Point = 206° C.) | | | 12% | | | | | |
| | | Elastollan ET690 (Softening Point = 120~150° C.) | | | | | | 24% | | |
| | Magnetic material (Iron powder) | Percent by mass (wt %) | 40% | 40% | 40% | 40% | 40% | 40% | 70% | 0% |
| | | Percent by volume (vol %) | 10.5% | 10.5% | 10.5% | 10.5% | 10.5% | 10.5% | 29.0% | 0.0% |
| | Fluidity | MVR(3.16 kg, 260° C.)($cm^3$/10 min) | 12.5 | 11.0 | 9.6 | 23.3 | 0.8 | OVER | 0.2 | 0.6 |
| | Continuous Extrusion Method | Extrusion Moldability | Good Co-extrusion | Good Co-extrusion | Good Co-extrusion | Pass Co-extrusion | Good Single extrusion | Poor Impossible molding due to too low viscosity | Poor Impossible molding due to too low viscosity | Good Single extrusion |
| | Single Hook Hanging Test | Positive Releasing Side Strength (N) | 2 | 1.8 | 2.1 | 1.9 | 1.9 | — | — | 1.9 |
| | | Reverse Releasing Side Strength (N) | 1.3 | 1.2 | 1.2 | 1.2 | 1.1 | — | — | 1.4 |
| | | Crack After Testing | Absence | Absence | Absence | Absence | Presence | — | — | Absence |
| | Magnet Attraction Test | Attraction Force (N) | 2.1 | 2.0 | 2.5 | 2.3 | 1.5 | — | — | — |

DESCRIPTION OF REFERENCE NUMERALS

1 molded surface fastener
10 substrate portion
20 protective wall section
30 engaging element
50 lateral wall section
60 fin piece
11 concave groove portion
21 longitudinal wall section
22 connecting portion
23 reinforcement section
24 longitudinal wall
28 gap
21*a* first row longitudinal wall section
21*b* second row longitudinal wall section
21*c* third row longitudinal wall section
25 pillar portion
26 top surface portion
30 engaging element
31 stem portion
32 engaging head
100 production device for molded surface fastener (for first molded product)
101 first extrusion die
101*a* extrusion port
102 first die wheel
102*a* cavity
103 synthetic resin
105 first molded product
110 surface fastener
111 cushion body
121 mold
122 surface fastener
123 magnet
200 production device for molded surface fastener (for second molded product)
201 second extrusion die
201*a* extrusion port
202 second die wheel
202*a* cavity
207 guide portion
203 synthetic resin
205 second molded product
305 integrally molded product
400 production device for molded surface fastener (for co-extrusion molding)
401 extrusion die
401*a* upper extrusion port
401*b* lower extrusion port
402 die wheel
402*a* cavity
401*a*-1 nozzle portion

401*a*-2 recess
403*a* synthetic resin
401*b*-1 nozzle portion
401*b*-2 recess
403*b* synthetic resin material
405 integrally molded product

What is claimed is:

1. A molded surface fastener, the molded surface fastener being integrally molded using a first resin composition and a second resin composition as materials, the molded surface fastener comprising a substrate portion in a form of plate and a plurality of engaging elements that protrude from one main surface of the substrate portion, at least a part of the substrate portion being made of the first resin composition, and at least a part of the engaging elements being made of the second resin composition, wherein the first resin composition comprises 80% by mass or more of a thermoplastic polyester and does not contain a magnetic material, and wherein the second resin composition comprises a thermoplastic polyester, a thermoplastic polyester elastomer and a magnetic material at a total content of 90% by mass or more, a content of the magnetic material is from 20 to 50% by mass, and a content ratio by mass of the thermoplastic polyester and the thermoplastic polyester elastomer is in a range of the thermoplastic polyester/the thermoplastic polyester elastomer =50/50 to 90/10.

2. The molded surface fastener according to claim 1, wherein the second composition has a relationship of an equation: $Tm_2 - 40°$ C. $< Tm_1 < Tm_2$, where $Tm_1$ represents a melting point of the thermoplastic polyester elastomer and $Tm_2$ represents a melting point of the thermoplastic polyester.

3. The molded surface fastener according to claim 1, wherein both the first resin composition and the second resin composition have a melt volume rate (MVR) at 260° C. of 0.3 $cm^3$/10 min or more and 20 $cm^3$/10 min or less.

4. The molded surface fastener according to claim 1, wherein a ratio ($MVR_2/MVR_1$) of a melt volume rate of the second resin composition ($MVR_2$) to a melt volume rate of the first resin composition ($MVR_1$) is from 0.5 to 40.

5. The molded surface fastener according to claim 1, wherein the molded surface fastener is comprised of three regions: a central part having boundary lines along its longitudinal direction; and left and right side edge parts thereof; wherein each of the three regions has the substrate portion and the engaging elements, wherein for the central part, both the substrate portion and the engaging elements are made of the second resin composition, and wherein for the left and right side edge parts, both the substrate portion and the engaging elements are made of the first resin composition.

6. The molded surface fastener according to claim 1, wherein the molded surface fastener is comprised of three regions: a central part having boundary lines along its longitudinal direction and left and right side edge parts thereof; wherein each of the three regions has the substrate portion and the engaging elements, wherein for the central part, at least a part of the substrate portion is made of the first resin composition and all the engaging elements are made of the second resin composition, and wherein for the left and right side edge parts, both the substrate portion and the engaging elements are made of only the first resin composition.

7. The molded surface fastener according to claim 1, wherein the substrate portion has the first resin composition more than the second resin composition by volume fraction, and the engaging elements has the second resin composition more than the first resin composition by volume fraction.

8. The molded surface fastener according to claim 1, wherein a volume fraction of the second resin composition to the first resin composition is the second resin composition/the first resin composition =10/90 to 90/10.

9. The molded surface fastener according to claim 1, wherein said one main surface of the substrate portion further comprises a pair of left and right protective wall sections placed along a longitudinal direction on an outerside in a width direction of the plurality of engaging elements, and the protective wall sections are made of the first resin composition.

10. The molded surface fastener according to claim 1, wherein at least a part of another main surface of the substrate portion is made of the first resin composition.

* * * * *